US010569932B2

(12) United States Patent
Pietsch

(10) Patent No.: US 10,569,932 B2
(45) Date of Patent: Feb. 25, 2020

(54) PACKAGE FOR HOLDING PACKAGED GOODS

(71) Applicant: Wolf-Ruediger Pietsch, Hoevelhof (DE)

(72) Inventor: Wolf-Ruediger Pietsch, Hoevelhof (DE)

( * ) Notice: Subject to any disclaimer, the term of this patent is extended or adjusted under 35 U.S.C. 154(b) by 88 days.

(21) Appl. No.: 15/623,523

(22) Filed: Jun. 15, 2017

(65) Prior Publication Data

US 2017/0361990 A1 Dec. 21, 2017

(30) Foreign Application Priority Data

Jun. 15, 2016 (DE) ..... 20 2016 103 152 U

(51) Int. Cl.

| | |
|---|---|
| ***B65D 25/28*** | (2006.01) |
| ***B65D 71/00*** | (2006.01) |
| ***B65D 5/46*** | (2006.01) |
| ***B65D 21/02*** | (2006.01) |

(52) U.S. Cl.

CPC ..... *B65D 25/2867* (2013.01); *B65D 5/46016* (2013.01); *B65D 21/0205* (2013.01); *B65D 25/2873* (2013.01); *B65D 71/0085* (2013.01)

(58) Field of Classification Search

CPC ..... B65D 25/2867; B65D 71/0085; B65D 21/0205; B65D 5/46016; B65D 25/2873

USPC ..... 220/752

See application file for complete search history.

(56) References Cited

U.S. PATENT DOCUMENTS

| | | | | |
|---|---|---|---|---|
| 3,114,496 | A | 12/1963 | Wilcox | |
| 4,299,324 | A | 11/1981 | Dickens | |
| 4,819,410 | A * | 4/1989 | Skinner | B65B 17/02 53/413 |
| 6,565,697 | B1 * | 5/2003 | Maercklein | C09J 7/38 156/289 |

(Continued)

FOREIGN PATENT DOCUMENTS

| | | |
|---|---|---|
| CH | 505588 A | 4/1971 |
| DE | 1964656 U | 7/1967 |
| DE | 9319932 U1 | 6/1994 |

(Continued)

OTHER PUBLICATIONS

German Search Report issued in German Application No. DE 20 2016 103 152.4 dated Apr. 21, 2017.

*Primary Examiner* — Anthony D Stashick
*Assistant Examiner* — James M Van Buskirk
(74) *Attorney, Agent, or Firm* — Patent Central LLC; Stephan A. Pendorf

(57) ABSTRACT

A package for holding packaged goods, with a packaging body containing multiple packaging sides to create an essentially closed packaging volume, wherein the packaging body features a first packaging part and at least one second packaging part to form a boundary line between an edge section of the first packaging part and an edge section of the second packaging part, with a carrying handle which is connected in a fixing section through locking adhesive elements, and which features a suspension loop for grasping the carrying handle, wherein at least two locking adhesive elements respectively lie in an adhered state solely on an edge section of the first packaging part, and on an edge section of the second packaging part, and wherein the carrying handle runs along the boundary line of the packaging body.

18 Claims, 1 Drawing Sheet

(56) References Cited

U.S. PATENT DOCUMENTS

Figure 1:
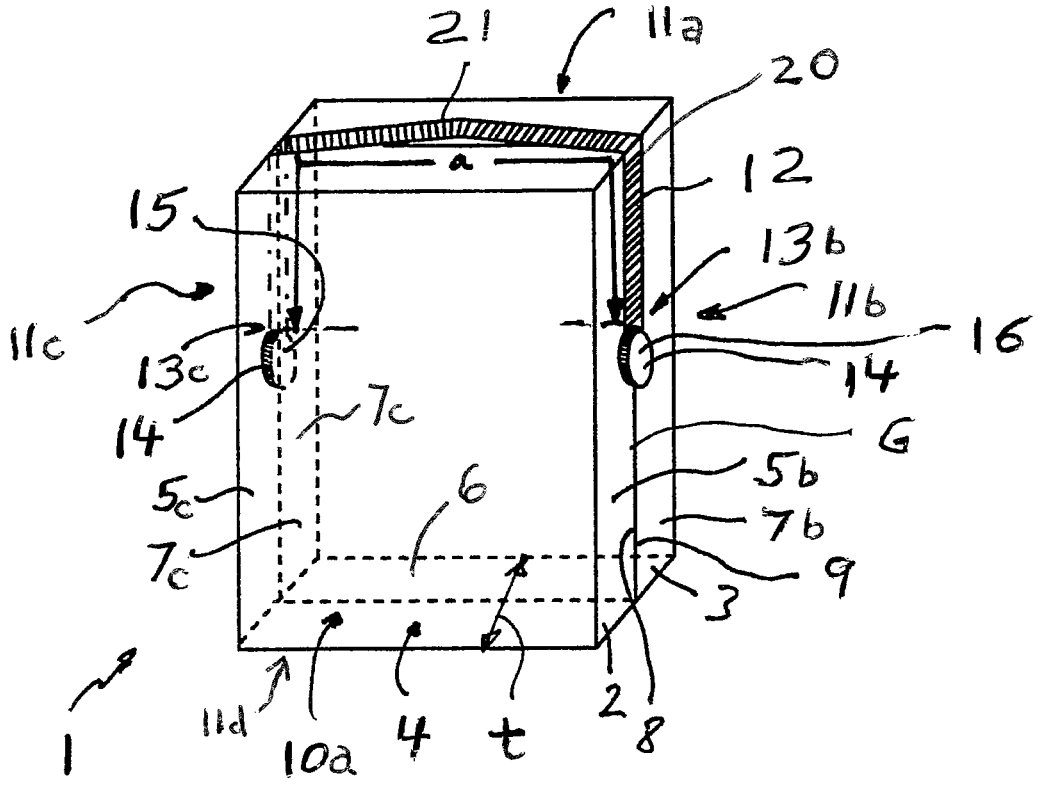

2009/0255946 A1 10/2009 Rose et al.

FOREIGN PATENT DOCUMENTS

| | | | |
|---|---|---|---|
| DE | 9419554 | U1 | 2/1995 |
| DE | 202006009335 | U1 | 9/2006 |
| DE | 202006011056 | U1 | 9/2006 |
| DE | 102006049147 | A1 | 4/2008 |
| GB | 1008598 | A | 10/1965 |
| GB | 2289880 | A | 12/1995 |

* cited by examiner

PACKAGE FOR HOLDING PACKAGED GOODS

The invention concerns an OA1 package for holding packaged products with a packaging body containing multiple packaging sides to create an essentially closed packaging volume, wherein the packaging body features a first packaging part and at least one second packaging part to form a boundary line between an edge section of the first packaging part and an edge section of the second packaging part, with a carrying handle which is connected in a fixing section through locking adhesive elements, and which features a suspension loop for creating the carrying handle.

According to DE 10 2006 049 147 A1, a package for holding packaged products is an object that consists of a cuboid-shaped packaging element. The packaging element features a carrying handle on an upper side so that it is easy to carry. The handle enclosing the top of the packaging element is U-shaped, wherein opposite ends of the handle are firmly and permanently connected to the packaging body. The carrying handle is to form a fold at the opposite package sides, which can be released and/or unlocked by releasing a release tab, so that the carrying handle is extendable upwards and carrying the package is assured when grasping the carrying handle. Indeed, the package in question allows for technically simple carrying of the package. Opening and closing the package occurs with separate measures.

A package for holding packaged products is known from DE 20 2006 009 335 U1, with which a packaging body is created as a box with a first packaging part formed as a basic body and with a second packaging part formed as a lid. In order to the carry the packaging body thus formed, a carrying handle is provided which is fixed in a fixing section through locking adhesive elements. A non-fixing section of the carrying handle is formed by a suspension loop for creating the carrying handle. The packaging body is essentially closed by setting the lid onto the basic body. Due to the fact that the suspension loop is arranged at the top, i.e. above the lid, on the one hand, and the locking adhesive elements are arranged on opposite packaging sides on the other, an opening of the packaging body during carrying is prevented. The disadvantage of the known packaging is that the degree of effort required to open the package is relatively high.

To accomplish this task, the invention, in connection with the preamble of patent claim 1, is characterized in that at least two locking adhesive elements respectively lie in an adhered state solely on an edge section of the first packaging part, and on an edge section of the second packaging part, and that the carrying handle runs along the boundary line of the packaging body.

By attaching the locking adhesive elements, the invention simultaneously allows for packaging and using the carrying handle, so that the packaged goods can be protected and transported comfortably. The basic idea of the invention is to use the sealing adhesive elements for the preferably detachable connection of packaging parts and for the attachment of a carrying handle. Due to the fact that the carrying handle runs along a boundary line between a first packaging part and a second packaging part, an additional stabilisation or a holding force that facilitates the closure of the first packaging part with the second packaging part occurs (fastening force). Unpacking is made easier since after a loosening of the locking adhesion elements, the conjoined packaging parts can immediately be separated from each other.

According to a preferred embodiment of the invention, the locking adhesive elements are each arranged on an end section of the carrying handle. A non-fixing section of the carrying handle not only comprises the carrying loop, which can be arranged at a distance to the packaging side, but also a section of another packaging side of the packaging body, wherein the carrying handle lies flat on the other side in the transport position on the edge section of the first packaging part and the second packaging part and the boundary line between them. The locking adhesive elements are preferably located on the other packaging side of the packaging body. Advantageously, a fastening force can be created as a result which closes the packaging body. The carrying handle thus essentially extends fully along the boundary line between the packaging parts. The locking adhesive elements have been designed so large that on the one hand at least two packaging parts can connected to each other and on the other, when using the handle, the weight of the packaging and/or packaged goods can be supported.

According to a further development of the invention, the locking adhesive elements are arranged on opposite packaging sides of the packaging body, so that the carrying loop is assigned to a packaging that borders these two packaging sides and interconnects them. The advantage of this is that a stable, transportable packaging body is created which can be manually grasped and thus easily transported.

According to a preferred embodiment of the invention, the locking adhesive elements are securely connected to the carrying handle. Preferably, this should be on the end areas or ends of the handle, so that by attaching the locking adhesive elements, by applying adhesive side thereof on one edge of the first package part and on an edge of the second package part, a solid and stable link between the packaging parts is achieved. The adhesive surface is arranged so with an adhesive on one side and a non-bonding surface on the other side.

In a further development of the invention, a self-adhesive film forms the adhesive surface so that the adhesive film, for example, can be exposed by pulling off a protective film and then adhered to the edges of at least two parts of the packaging.

In a further development of the invention, the locking adhesive element is designed in a polygonal, circular or oval shape and has a dimension in the range of 5 mm to 200 mm between the two opposite edges of the locking adhesive element. In this way it is ensured that, depending on the weight of the packaged product, an adequate adhesive bond between the packaging parts themselves or between the respective packaging elements and the grip is ensured.

In a further development of the invention, the package is cuboid-formed, whereby at least two locking adhesive elements are mounted on different sides of the packing box and whereby base sides of the first and second packaging part run parallel to each other. The ratio between a depth of the narrow side of the packaging body and the dimension of the locking adhesive element that runs vertical to the boundary line is smaller than two and higher than one. In this manner, only one portion of a depth of the narrow side of the packaging body is covered by the locking adhesive element. The extension of the locking adhesive element in the direction of the boundary line is preferably also less than a depth of the narrow side of the packaging body, so that a loosening of the carrying handle is simply ensured by grasping said handle in the non-fixing section that follows the locking adhesive element.

In a further development of the invention, a distance along the package sides is less than a length of the handle strap between two adhesive points created by the locking adhesive elements, whereby the length of the handle strap is defined by the spacing of locking adhesive elements arranged at the ends. In this way it is ensured that a suspension loop for creating the carrying handle may form.

In a further development of the invention, the handle is produced from a paper, plastic, natural or composite material, or is made of one or more of these materials. The packaging may be formed from paper, cardboard, plastic or any non-woven material.

An example design of the invention based on the drawings is explained in detail below.

The drawings illustrate:

FIG. 1 a perspective view of a package and

Figure 2:
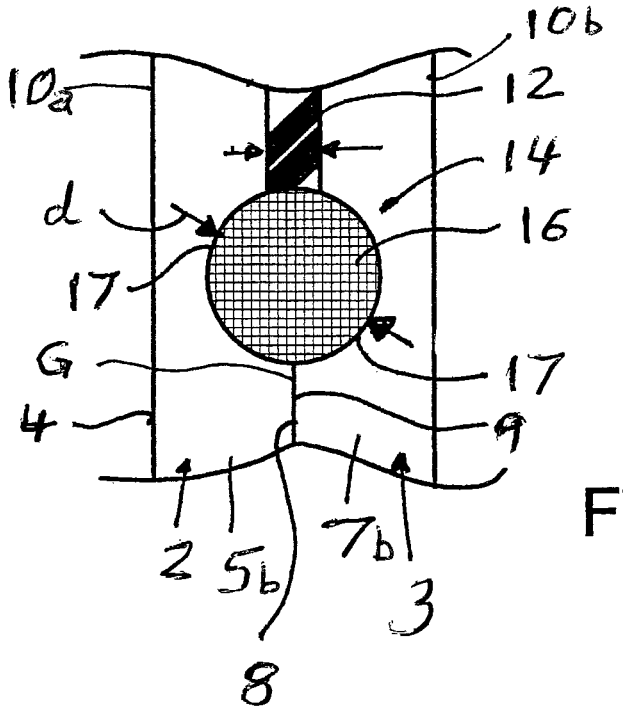

FIG. 2 an enlarged view of a packaged side of the package.

A package for holding packageable goods, the goods not illustrated here, consists of a packaging body 1 which is formed in the present embodiment by a first packaging part 2 and a second packaging part 3. The first packaging part 2 and the second packaging part 3 encompass a package volume, in which objects can be arranged as packaged goods. The packaging body 1 is formed like a shoe box, the first packaging part 2 has a base side 4 and connected to the edge of the base side 4 are narrow sides 5*b*, 5*c* at right angles to the base side. The second packaging part 3 also has a base side 6 and narrow sides 7*b*, 7*c* connected at right angles to the base side In order to seal the packaging body 1, the first packaging part 2 and second packaging part 3 are brought into contact with each other, wherein marginal edges 8 of the first packaging part 2 and marginal edges 9 of the second packaging part 3 are positioned flush to each other. The edges 8, 9 thus form a circumferential boundary line G of the packaging body 1. The edges 8 of the first packaging part 2 and the peripheral edge 9 of the second packaging part 3 are arranged in an edge portion of the first packaging part 2 and the second packaging part 3. The first packaging part 2 and the second packaging part 3 are arranged in each case somewhat in a trough-shape, wherein the short sides 5*b*, 5*c*, 7*b*. 7*c* of the packaging part 2 and 3 certainly can have various heights.

To put the packaging body 1 in a transport position, the first packaging part 2 and the second packaging part 3 are brought into abutment to each other, as is evident in FIG. 1. The edges 8, 9 of the first packaging part 2 and second packaging part 3 are positioned flush to each other so that a cuboid packaging body 1 or a cuboid-shaped packaging with opposing large packaging sides 10*a*, 10*b* and connecting the same narrow packaging sides 11*a*, 11*b*, 11*c* and 11*d* are formed. The narrow packaging sides 11*a*, 11*b*, 11*c* and 11*d* of the packaging body 1 respectively form a narrow side of the packaging body 1 with a depth t that runs perpendicular to the aims are amended for clarity so that the ca10*a*, 10*b* of the packaging body 1 are designed to have a a large area relative to the packaging body 1 and extent parallel to each other at the distance t.

To fix the first packaging part 2 to the second packaging part 3 and for preparation for manual transport, a handle strap 12 designed as a carrying handle is provided, which at the respective ends is provided with fixing sections 13*b*, 13*c*, each of which featuring a locking adhesive element 14. The handle strap 12 runs along the boundary line G of the packaging body 1. In the present exemplary embodiment, the handle strap 12 runs along three narrow sides 11*a*, 11*b* and 11*c* of the packaging body 1. The locking adhesive elements 14 are arranged on opposite narrow sides 11*b* and 11*c*, which in the present exemplary embodiment are arranged opposite from each other in parallel. A carrying loop 21 is arranged on an upper narrow side 11*a* of the packaging body 1, which connects the two opposite, preferably upright, narrow sides 11*b* and 11*c*. The narrow side 11*a* of the packaging body 1 forms an upper side of the packaging body 1 in the transport position.

The strip-shaped handle strap 12 features the locking adhesive element 14 solely on the ends 13, wherein the locking adhesive element 14 is located in a fixing section 13 of the handle strap 12. A non-fixing section 20 of the carrying handle 12 connects to the locking adhesive element 14 or the fixing section 13 of the carrying handle 12, which extends from the one locking adhesive element 14 to the other locking adhesive element 14. In the transport position, the non-fixing section 20 of the carrying handle 12 lies flat on the opposite narrow sides 11' of the packaging body 1, while on the upper narrow side 11" it runs at a distance from the narrow side 11" when the carrying loop 21 is grasped. The flat, non-adhesive contact of the non-fixing section 20 on the narrow sides 11' of the packaging body 1 results in a tension acting on the handle strap 12, which is extended due to the upwardly acting holding force of the carrying loop 21.

The locking adhesive element 14 is—much like the handle strap 12—designed to be flat and features on one side 15 a bonding surface and also features a non-adhesive surface on the second side 16. The locking adhesive element 14 is circular in design and has a size between the two opposite edges 17 of the adhesive surface or a diameter d in the range of 5 mm to 200 mm. The dimension of the locking adhesive element 14 is large enough that after removing a protective film, a formed self-adhesive film adhesive surface is exposed 15 so that after application of same to the marginal edge 8 of the first packaging part 2 and the peripheral edge 9 of the second packaging part 3, the edge portions of the two packing parts 2, 3, these are securely connected with each other. In the example presented, the locking adhesive elements 14 are preferably mounted at the same height on the opposite narrow packaging sides 11*b* and 11*c* of the packaging body 1, preferably equal marginal portions of the first packaging part 2 and the second packaging part 3 will be encompassed by the adhesive surface 15. The diameter of the locking adhesive element 14 may be in a range between 10 mm to 200 mm, preferably in the range of 10 mm to 80 mm, for example 35 mm. For example, the width of the strap handle 12 is 10 mm.

So that from the handle strap 21 for grasping forms a carrying strap, the two locking adhesive elements 14 each form an adhesive point in such an area of the narrow packaging sides 11*b*, 11*c* and are arranged so that the distance between the formed adhesive points along the packaging sides 10*a*, 10*b*, 11*b*, 11*c* is less than the length the handle strap 12. Here it is assumed that the length of the handle strap 12 is defined by the distance between the two end locking adhesive elements 14 when the handle strap is extended 12.

Adhering the locking adhesive elements 14 thus forms a carrying strap 21, so that the packaging body 1 can be manually collected and transported.

In the present exemplary embodiment, due to the flush contact of the narrow sides 5*b*, 7*b* and 5*c*, 7*c* of the first packaging part 2 with the second packaging part 3, the sum of the depths of these narrow sides 5*b*, 7*b* and 5*c*, 7*c* corresponds to the depth t of the narrow side 11*a*, 11*b* and 11*c* of the packaging body 1. The locking adhesive element 14 features a dimension d that runs transverse to the handle strap 12 or transverse to the boundary line G, which is less than the depth t of the narrow side 11*a*, 11*b* and 11*c* of the packaging body 1 and which is larger than the half-depth t of the narrow side 11*a*, 11*b* and 11*c* of the packaging body 1. In the direction of the boundary line G and in the direction of the handle strap 12, the dimension d of the locking adhesive element 14 is less than the depth t of the narrow sides 11*a*, 11*b* and 11*c* of the packaging body 1 and greater than the half-depth t of the narrow sides 11*a*, 11*b* and 11*c* of the packaging body 1.

The dimension d of the locking adhesive element 14 is greater in the direction of the boundary line G and/or transverse to the boundary line G, and/or is unequal to a breadth b of the carrying strap 12 in the non-fixing section 20 of the same.

The first packing part 2 and the second packaging part 3 are preferably of equal size and respectively serve as packaging halves of the packaging body 1.

The handle strap 12 is integrally connected with the locking adhesive elements 14. The handle strap 12 may consist of a paper, plastic-natural material or a combination of these materials. The packaging body 1 may consist of a paper, cardboard, plastic material or non-woven material.

After the packaging body 1 has been transported to the desired location, by tearing away the locking adhesive elements 14 at the ends of handle strap 12 from the packaging body 1, it can be reopened, so that the packaged goods can be removed. The packaging material, which is formed by the container body 1 and the handle strap 12 and the locking adhesive elements 14 should, preferably, be made of the same material, so that all can be disposed together.

In an alternative, not depicted design of the invention, it is possible to use more than two locking adhesive elements 14 between the ends of the handle strap 12 or the carrying strap. Preferably, the locking adhesive elements 14 should be arranged an equal distance from each other or in an area near the end of the handle strap 12 rather than an area towards the center of the handle strap 12.

The locking adhesive elements 14 each form a fixing section of the handle strap 12. In a middle area of the handle strap 12 features a gripping section (carrying loop 21).

In an alternative, not depicted design of the invention, the locking adhesive elements 14 may also be polygonal or oval-shaped.

In an alternative, not depicted design of the invention, the peripheral edges 8, 9 of the packaging parts 2, 3 can also overlap, one above the other. The locking adhesive elements 14 cover this overlapping portion.

In an alternative, not depicted design of the invention, the packaging body 1 may also consist of more than two package parts. For sealing of the packaging body 1, at least at two portions thereof extend along the packaging parts so that the corresponding locking adhesive elements 14 can be mounted.

The invention claimed is:

1. A packaging for holding packaged goods within a packaging body (1) containing multiple packaging sides (10*a*, 10*b*, 11*a*, 11*b*, 11*c*, 11*d*) to create a closed packaging volume, whereby the packaging body (1) features a first packaging part (2) and at least one second packaging part (3) forming a boundary line (G) between an edge section (8) of the first packaging part (2) and an edge section (9) of the second packaging part (3), with a carrying handle (12) comprising a non-fixing section (20) and two fixing sections (13*b*, 13*c*), which carrying handle is fixed to the packaging at the fixing sections (13*b*, 13*c*) through first and second adhesive elements (14) arranged at a distance (a) from each other, and which in the non-fixing section (20) features a carrying loop (21) for grasping the carrying handle (12), wherein the first and second adhesive elements (14) respectively lie in an adhered state solely on an edge section (8) of the first packaging part (2) and on an edge section (9) of the second packaging part (3), wherein the carrying handle (12) runs along the boundary line (G) of the packaging body (1), and wherein a distance (a) between two adhesion points produced by the locking adhesive elements (14) along the packaging sides (10*a*, 10*b*, 11*b*, 11*c*) is less than a length of the handle strap (12), whereby the length is defined by a distance between the locking adhesive elements (14).

2. The packaging according to claim 1, wherein an area of the non-fixing section (20) of the carrying handle (12) that runs on one packaging side (11*b*, 11*c*), on which the locking adhesive elements (14) are affixed, lies in a non-adhesive manner at least in a transport position flat on the edge section (8) of the first packaging part (2) and on the edge section (9) of the second packaging part (3) and on the boundary line (G).

3. The packaging according to claim 1, wherein the first locking adhesive element and the second locking adhesive element are respectively arranged in one fixing section (13*b*, 13*c*) of the carrying handle (12) designed as a handle strap on opposite packaging sides (11*b*, 11*c*) of the packaging body (1).

4. The packaging according to claim 1, wherein an area of the non-fixing section (20) of the carrying strap (12) that runs on one packaging side (11*a*) that connects the opposite packaging sides (11*b*, 11*c*) is arranged at a distance from the packaging side (11*a*).

5. The packaging according to claim 1, wherein the locking adhesive elements (14) are firmly fixed to the non-fixing section (20) of the carrying handle (12) and wherein the locking adhesive elements (14) are equipped on a first flat side with an adhesive surface (15) and on a second flat side with a non-adhesive surface (16).

6. The packaging according to claim 5, wherein the adhesive surface (15) is designed as a self-adhesive foil.

7. The packaging according to claim 1, wherein the locking adhesive elements (14) form ends (13) of the carrying handle (12).

8. The packaging according to claim 1, wherein the edge section (8) of the first packaging part (2) and the edge section (9) of the second packaging part (3) lie flush or overlapping with each other.

9. The packaging according to claim 1, wherein the handle strap (12) consists of a paper, cardboard, plastic, a natural material or a combination of one or at least two of these materials.

10. The packaging according to claim 1, wherein the first packaging part (2) and the second packaging part (3) consist of paper or cardboard or synthetic material, or a non-woven material.

11. A packaging for holding packaged goods within a packaging body (1) containing multiple packaging sides (10*a*, 10*b*, 11*a*, 11*b*, 11*c*, 11*d*) to create a closed packaging volume, whereby the packaging body (1) features a first packaging part (2) and at least one second packaging part (3) forming a boundary line (G) between an edge section (8) of the first packaging part (2) and an edge section (9) of the second packaging part (3), with a carrying handle (12) comprising a non-fixing section (20) and two fixing sections (13*b*, 13*c*), which carrying handle is fixed to the packaging at the fixing sections (13*b*, 13*c*) through first and second adhesive elements (14) arranged at a distance (a) from each other, and which in the non-fixing section (20) features a carrying loop (21) for grasping the carrying handle (12), wherein the first and second adhesive elements (14*b*, 14*c*) respectively lie in an adhered state solely on an edge section (8) of the first packaging part (2) and on an edge section (9) of the second packaging part (3), and wherein the carrying handle (12) runs along the boundary line (G) of the packaging body (1), whereby the locking adhesive elements (14) are polygonal, circular or oval, and feature a dimension (d) in the range of 5 mm to 200 mm between two opposite edges (17) of the same.

12. The packaging according to claim 11, wherein the edge section (8) of the first packaging part (2) and the edge section (9) of the second packaging part (3) lie flush or overlapping with each other.

13. The packaging according to claim 11, wherein the handle strap (12) consists of a paper, cardboard, plastic, a natural material or a combination of one or at least two of these materials.

14. The packaging according to claim 11, wherein the first packaging part (2) and the second packaging part (3) consist of paper or cardboard or synthetic material, or a non-woven material.

15. A packaging for holding packaged goods within a packaging body (1) containing multiple packaging sides (10*a*, 10*b*, 11*a*, 11*b*, 11*c*, 11*d*) to create a closed packaging volume, whereby the packaging body (1) features a first packaging part (2) and at least one second packaging part (3) forming a boundary line (G) between an edge section (8) of the first packaging part (2) and an edge section (9) of the second packaging part (3), with a carrying handle (12) comprising a non-fixing section (20) and two fixing sections (13*b*, 13*c*), which carrying handle is fixed to the packaging at the fixing sections (13*b*, 13*c*) through first and second adhesive elements (14) arranged at a distance (a) from each other, and which in the non-fixing section (20) features a carrying loop (21) for grasping the carrying handle (12), wherein the first and second adhesive elements (14) respectively lie in an adhered state solely on an edge section (8) of the first packaging part (2) and on an edge section (9) of the second packaging part (3), wherein the carrying handle (12) runs along the boundary line (G) of the packaging body (1), wherein the first packaging part (2) and the second packaging part (3) form a cuboid packaging body (1), wherein a base side (4) of the first packaging part (2) and a base side (6) of the second packaging part (3) run parallel to each other, and whereby narrow sides (5*b*, 5*c*) of the first packaging part (2) and narrow sides (7*b*, 7*c*) of the second packaging part (3) are arranged connected to the base side (4) of the first packaging part (2) or the base side (6) of the second packaging part (3), and wherein a narrow side of the packaging body (1) formed by the narrow ides (5*b*, 5*c*) of the first packaging part (2) and the narrow sides (7*b*, 7*c*) of the second packaging part (3) features a depth (t) which is greater than a dimension (d) of the locking adhesive elements (14) that runs transverse to the carrying handle (12), and which is smaller than double the dimension (d) of the locking adhesive elements (14) that runs transverse to the carrying handle (12).

16. The packaging according to claim 15, wherein the edge section (8) of the first packaging part (2) and the edge section (9) of the second packaging part (3) lie flush or overlapping with each other.

17. The packaging according to claim 15, wherein the handle strap (12) consists of a paper, cardboard, plastic, a natural material or a combination of one or at least two of these materials.

18. The packaging according to claim 15, wherein the first packaging part (2) and the second packaging part (3) consist of paper or cardboard or synthetic material, or a non-woven material.

* * * * *